US005827115A

United States Patent [19]

Shimizu

[11] Patent Number: 5,827,115

[45] **Date of Patent: *Oct. 27, 1998**

[54] POLISHING APPARATUS

[75] Inventor: Noburu Shimizu, Yokohama, Japan

[73] Assignee: Ebara Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 684,941

[22] Filed: Jul. 19, 1996

[30] Foreign Application Priority Data

Jul. 19, 1995 [JP] Japan ..... 7-205216
Jul. 19, 1995 [JP] Japan ..... 7-205217

[51] Int. Cl.[6] ..... B24B 7/00

[52] U.S. Cl. ..... 451/123; 451/127; 451/58

[58] Field of Search ..... 451/36, 58, 59, 451/41, 123, 140, 143, 254, 502, 503, 496, 497, 500, 531, 466, 5, 119, 120

[56] References Cited

U.S. PATENT DOCUMENTS

| | | | |
|---|---|---|---|
| 1,887,692 | 11/1932 | Driver | 451/497 |
| 2,145,980 | 2/1939 | Hadwiger et al. | 451/497 |
| 3,943,666 | 3/1976 | Dion et al. | 451/254 |
| 4,471,582 | 9/1984 | Neary | 451/502 |
| 4,837,985 | 6/1989 | Mayama | 451/502 |
| 5,486,134 | 1/1996 | Jones et al. | 451/59 |

FOREIGN PATENT DOCUMENTS 2-269552 11/1990 Japan .

*Primary Examiner*—Timothy V. Eley
*Assistant Examiner*—Derris H. Banks
*Attorney, Agent, or Firm*—Wenderoth, Lind & Ponack, LLP

[57] ABSTRACT

A polishing apparatus for polishing a workpiece such as a semiconductor wafer to a flat mirror finish includes a rotary drum provided on a surface thereof with a polishing pad. A stand supports the workpiece to be polished. A controlling device controls reciprocation of the drum and rotation of the workpiece to obtain a relationship:

$$V/\omega > L$$

in which V represents velocity of reciprocation of the drum reciprocating on the workpiece to polish an entire surface of the workpiece, ω represents rotational angular velocity of the workpiece, and L represents a distance from the rotational center of the workpiece to a radially outermost point on the workpiece.

6 Claims, 7 Drawing Sheets

POLISHING APPARATUS

BACKGROUND OF THE INVENTION

1. Field of the Invention

The present invention relates to a polishing apparatus and polishing method, and more particularly to a polishing apparatus and a polishing method for polishing a workpiece such as a semiconductor wafer to a flat mirror finish by a rotary drum provided on a surface thereof with a polishing pad.

2. Description of the Related Art

High density integrated semiconductor devices of recent years require increasingly finer microcircuits, and interline spacing thereof also steadily has been decreasing. For optical lithography operations based on less than 0.5 micrometer interline spacing, the depth of focus is shallow and high precision in flatness of a surface of the polished object is requires since such surface has to be coincident with the focusing plane of a stepper. This requirement means that the semiconductor wafer surface must be made extremely flat, and a first step in achieving such precision in flatness begins with proper surface preparation by polishing with a polishing apparatus.

Japanese Laid-Open Patent Publication No. 2-269552 discloses a polishing apparatus and polishing method using a rotary drum. The polishing apparatus is provided with a cylindrical polishing rotary drum facing a workpiece. A circumferential surface of the cylindrical drum contacts the workpiece along a linear contact line when the drum is rotated. An abrasive liquid is delivered into a portion between the surface of the rotary drum and the workpiece. When the workpiece is polished, the workpiece and the rotary drum are linearly moved in a direction having a specific angle to the rotational axis of the rotary drum.

In the apparatus and method using the rotary polishing drum, a large-size turntable, which is indispensable to a conventional widely-used turntable-type polishing apparatus, is not required and the size and weight of the apparatus can be reduced. Also, since the polished surface of the workpiece or the semiconductor wafer can be visibly observed during polishing processing, the amount of polishing or the amount of residual layer at a certain point of time can be measured.

In the drum-type polishing apparatus, the rotating rotary drum provided on its surface with the polishing pad is pressed against the surface of the semiconductor wafer and is reciprocated thereon to polish the surface. Thus, when the wafer surface is equally polished by reciprocation of the drum, a desired amount of polishing and a desired flatness of the surface are obtained when reciprocation is repeated.

However, due to a peripheral edge of the wafer and variation of the pressure applied to the workpiece with a variation of the length of contact line between the wafer and the drum, the amount of polishing in each reciprocating motion is not equal throughout the wafer surface. As one countermeasure for preventing irregular polishing, a sacrifice plate may be provided at a periphery of the wafer to remove the influence of the peripheral edge of the wafer. Also, the pressure to the wafer, rotational speed of the drum, and speed of reciprocal movement of the drum may be controlled to compensate for a variation of the pressure applied to the wafer surface. Even by these countermeasures, it is difficult to remove the above-described influence and to obtain a satisfactory degree of equal polishing over the entire surface of the wafer.

As the polishing pad, a polyurethane molded article having fine recesses or a non-woven fabric usually are used for easily retaining abrasive liquid. However, since the pad surface does not have a perfectly smooth flat surface, when the drum linearly reciprocates many times on the fixed semiconductor wafer or workpiece, fine striped patters are formed on the polished surface, and this deteriorates the quality of the surface.

In order to obtain a satisfactory polished surface throughout the entire wafer, the wafer should be rotated during reciprocating motion of the polishing drum. When the wafer is rotated, the drum moves across the wafer uniformly. In this case, the amount of polishing during each reciprocating motion is averaged across the wafer, and thus a flatter surface is obtained. Also, the pad does not pass along the same path and the stripe patterns mentioned above are not formed.

In order to obtain uniformly polished surface to a certain extent, the wafer must be rotated at least once during a given time of polishing. When the rotational speed is increased by a certain amount, the flatness of the polished surface is maintained in an allowable range. However, it has been observed that when the rotational speed is increased excessively, polishing irregularities are increased.

The polishing pad mounted on the rotary drum is, for example, non-woven fabric or a polyurethane sheet as mentioned before. Since the polishing pad is secured on the drum through adhesive, a seam of the pad is formed in the surface of the drum. Conventionally, the seam is formed parallel to the rotational axis of the drum. When the seam of the pad is formed parallel to the rotational axis of the drum, the continuity of the pad along a circumferential surface of the drum is interrupted by such seam. Therefore when the surface of the drum rotates while polishing a workpiece, impacts occur due to interruptions by the seam. Because of such impacts, the workpiece cannot be uniformly polished and the flatness of the workpiece is deteriorated.

When the workpiece is, for example, a semiconductor wafer, it is necessary to polish fine convex portions and concave portions to a microscopically flat surface. When the semiconductor wafer is polished, a hard material such as polyurethane is used as the polishing pad. When a single-layer polishing pad of such hard material lacking in elasticity is mounted on the drum, deflection of the drum occurs due to small errors in roundness of the drum and positioning of the rotation axis thereof, which cause vibration during polishing. Such vibration causes noise and deteriorates the flatness of the polished surface of the workpiece. Also, since the hard polishing pad deforms by only a small amount, the width of contact between the workpiece and the pad is decreased. Thus, the speed of polishing speed is reduced.

When water absorbing non-woven fabric material is provided as a lower layer of the polishing pad between the drum and the polishing pad, contraction and expansion of the nonwoven fabric are repeated. Ultimately, the non-woven fabric material absorbs water and the polishing pad peels away.

The polishing pad becomes worn out after a certain amount of use and requires periodic replacement. A thin polishing pad easily is worn out in a relatively short period of time and frequent replacement is required. This decreases the production efficiency of the polishing apparatus.

SUMMARY OF THE INVENTION

It is therefore an object of the present invention to provide a polishing apparatus and a polishing method using a rotary drum, in which a rotating workpiece is suitably polished by reciprocating the rotary drum without causing polishing irregularities.

It is also another object of the present invention to provide a polishing apparatus and a polishing method utilizing advantages of a polishing apparatus employing a rotary drum, which can suitably polish a workpiece without causing impacts to the workpiece.

According to a first aspect of the present invention, there is provided a polishing apparatus comprising a rotatable drum provided on a surface thereof with a polishing pad, a stand on which is positioned a workpiece to be polished, and pressing means for pressing the drum to a surface of the workpiece. Reciprocating means reciprocates one of the stand and the drum so that the drum contacts the entire surface of the workpiece. Rotating means rotates the workpiece. Supplying means delivers an abrasive liquid including abrasive grains to the polishing pad. Controlling means controls the reciprocating means and the rotating means to obtain a relationship:

$$V/\omega > L$$

in which V represents velocity of relative reciprocation between the drum and the workpiece to polish an entire surface of the workpiece, ω represents rotational angular velocity of the workpiece, and L represents a distance from a rotational center of the workpiece to a point on the workpiece furthest from the rotational center.

According to a second aspect of the present invention, there is provided a method for polishing a workpiece by use of a polishing apparatus comprising a rotatable drum provided on a surface thereof with a polishing pad, a stand on which is positioned a workpiece to be polished, pressing means for pressing the drum to a surface of the workpiece, reciprocating means for reciprocating one of the stand and the drum so that the drum contacts an entire surface of the workpiece, rotating means for rotating the workpiece, and supplying means for delivering an abrasive liquid including abrasive grains to the polishing pad. The method comprises controlling the reciprocating means and the rotating means so as to obtain a relationship:

$$V/\omega > L$$

in which V represents velocity of relative reciprocation between the drum and the workpiece to polish an entire surface of the workpiece, ω represents rotational angular velocity of the workpiece, and L represents a distance from a rotational center of the workpiece to a point on the workpiece furthest from the rotational center.

According to the first and second aspects of the invention, an entire surface of the rotating workpiece can be polished to a flat surface by a reciprocating drum without polishing irregularities.

According to a third aspect of the present invention, there is provided a polishing apparatus comprising a rotatable drum provided on a surface thereof with a polishing pad, a stand on which is positioned a workpiece to be polished, and pressing means for pressing the drum to a surface of the workpiece. Reciprocating means reciprocates one of the stand and the drum so that the drum contacts the entire surface of the workpiece. Rotating means rotates the workpiece. Supplying means delivers an abrasive liquid including abrasive grains to the polishing pad. A seam of the cylindrical polishing pad extends diagonally with respect to a rotating axis of the drum.

According to the third aspect of the present invention, the polishing pad provided on the rotating drum is seamed, but polishing, observed from the direction of the workpiece, will not be interrupted because the seam is arranged diagonally with respect to the rotational axis of the polishing drum. Thus, the problem of the conventional polishing apparatus, i.e. impacts occurring due to a seam of the pad extending parallel to the rotational axis, can be avoided.

According to a fourth aspect of the present invention, the polishing apparatus further includes a non-water absorbing elastic pad provided between the surface of said drum and the polishing pad. According to the fourth aspect of the present invention, the area of contact between the polishing pad and the workpiece is increased and the rate of polishing is increased because of deformation of the elastic pad. Also, since the elastic pad is a non-water absorbing material, the elastic pad does not absorb the abrasive liquid so that stable polishing can be conducted.

According to a fifth aspect of the present invention, there is provided a polishing apparatus comprising a rotatable drum provided on a surface thereof with a polishing pad, a stand on which is positioned a workpiece to be polished, pressing means for pressing the drum to a surface of the workpiece, reciprocating means for reciprocating one of the stand and the drum so that the drum contacts an entire surface of the workpiece, rotating means for rotating the workpiece, and supplying means for delivering an abrasive liquid including abrasive grains to the polishing pad, the polishing pad being a seamless cylindrical pad.

According to the fifth aspect of the present invention, there is no seam or step in the level of the polishing pad provided on the rotating drum, as observed from the workpiece. Thus, the problem of the conventional polishing apparatus, i.e. the occurrence of impacts due to the seam of the polishing pad, can be solved.

According to a sixth aspect of the present invention, there is provided a polishing apparatus including a polishing pad in the form of a thick cylinder shape mounted on the surface of said drum. According to the sixth aspect of the preent invention, since the polishing pad is formed to be a thick cylindrical shape, a long period of time is required to wear out the thick polishing pad. Therefore, frequent replacement of the polishing pad is avoided, which improves maintenance of the polishing apparatus.

The above and other objects, features and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
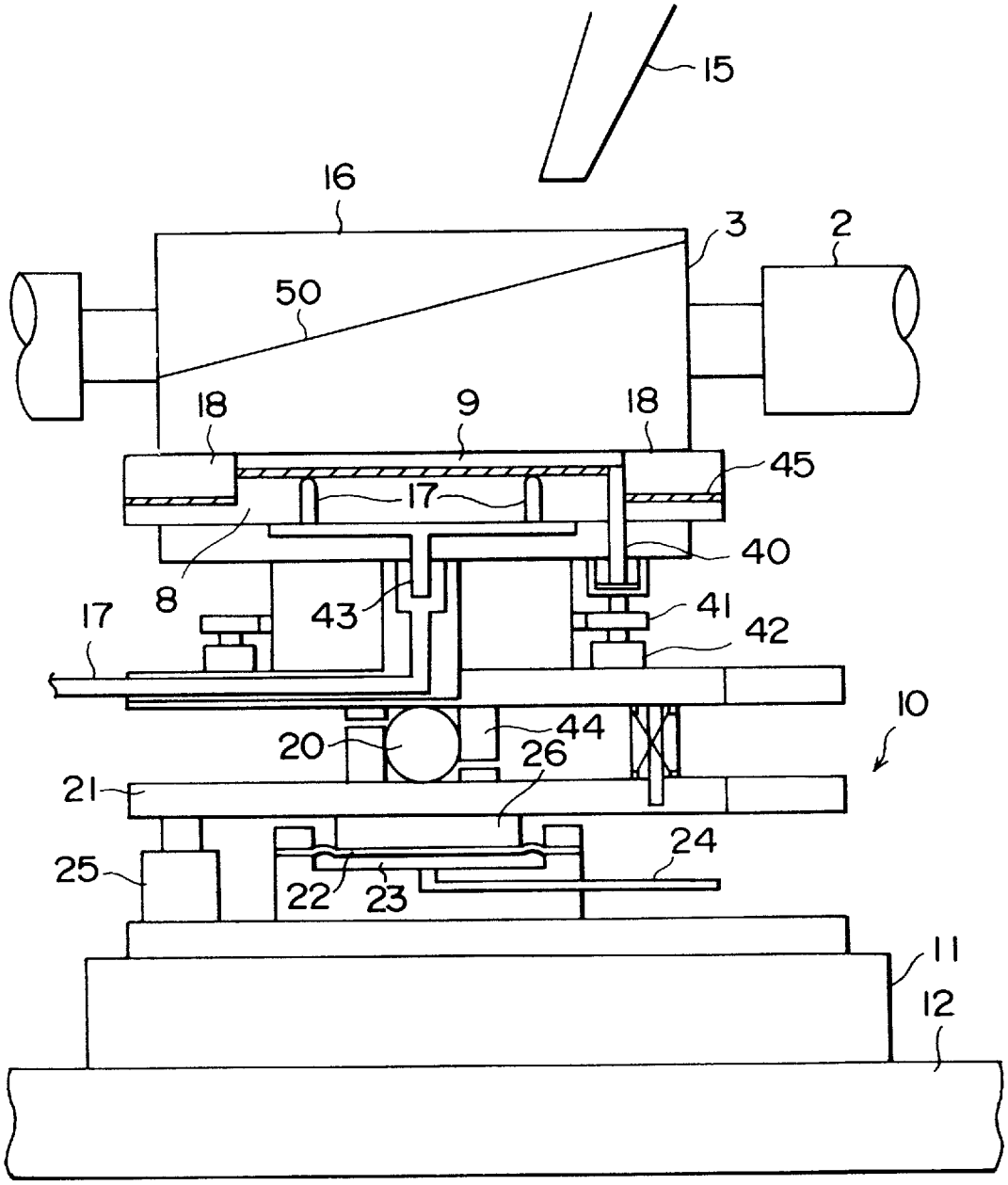
FIG. 1 is a schematic illustration showing a polishing apparatus of a first embodiment of the present invention.

Hereinafter, preferred embodiments of the present invention will be described, referring to the accompanying drawings. In the following description, the same reference numerals denote the same or similar features.

FIG. 1 shows a polishing apparatus of a first embodiment of the present invention. The polishing apparatus has a rotatable drum which is provided on a surface thereof with a polishing pad 16 retaining an abrasive liquid including abrasive grains. The rotational axis 2 of the drum 3 is supported by bearings in a drum head (not shown). The drum is rotated by a drum driving motor. A semiconductor wafer or workpiece 9 is placed on a stand 8 and is secured thereon by vacuum.

The stand 8 is secured to a Y-table 11 through a pressing means 10. The Y-table 11 is provided with a driving mechanism which moves the workpiece 9 in a Y-direction parallel to the rotational axis of the drum. An X-table 12 is provided with a driving mechanism which reciprocates the workpiece 9 in an X-direction perpendicular to the rotational axis of the drum along the entire length of the workpiece. The stand 8 is made rotatable by a rotary joint 43 so that the workpiece 9 can be rotated about its rotational axis by a driving mechanism (not shown). The X-table 12 reciprocates the workpiece in a direction perpendicular to the rotational axis of the drum at a velocity V and the stand 8 rotates the semiconductor wafer 9 at an angular velocity ω.

From an abrasive liquid supplying pipe 15, an abrasive liquid including abrasive grains is delivered to the polishing pad 16 provided on the surface of the drum 3 and retained therein. When the drum 3 is rotated about its rotational axis while contacting the semiconductor wafer 9, the semiconductor wafer 9 is polished by contacting surfaces therebetween. Various controlling factors such as the rotational velocity of the drum, velocity V of the reciprocating motion of the X-table 12 and the Y-table 11, a stroke of the reciprocating motion, and rotational angular velocity ω of the stand 8 can be controlled by a controlling device (not shown).

The polishing apparatus is provided with a sacrifice plate 18 for protecting and supporting the periphery of the workpiece. The semiconductor wafer or workpiece is attracted by vacuum to the stand 8 while being polished and is removed from the stand 8 by air pressure, after being polished, from a vacuum-pressure pipe 17. When the workpiece 9 is removed, a boosting ring 41 fixed to wafer boosting pin 40 is boosted or raised by a cylinder 42 to remove the workpiece from the stand 8.

The polishing apparatus includes two types of follow-up mechanism for pressing the workpiece to the surface of the rotating drum at a regular pressure. A first follow-up mechanism is a bar support 20 having a circular cross-section provided under the stand 8 and supporting the stand 8. The center axis of the bar support 20 is perpendicular or orthogonal to the rotational axis of the drum 3 and parallel to the surface of the stand 8. The second follow-up mechanism includes a diaphragm secured to a lower part of an elevating table 21 and an air cushion for supporting the diaphragm 22. The elevating table 21 is movable vertically by a ramp guide 25. A lower face of the elevating table 21 is secured to the diaphragm 22 through a connecting member 26. In the lower space under the diaphragm 22, pressurized air is supplied from an air pipe 24 to form the air cushion to support diaphragm 22.

Hereinafter, non-uniformity of Polishing due to reciprocation of the drum and rotation of the wafer will be described.

Figure 2:
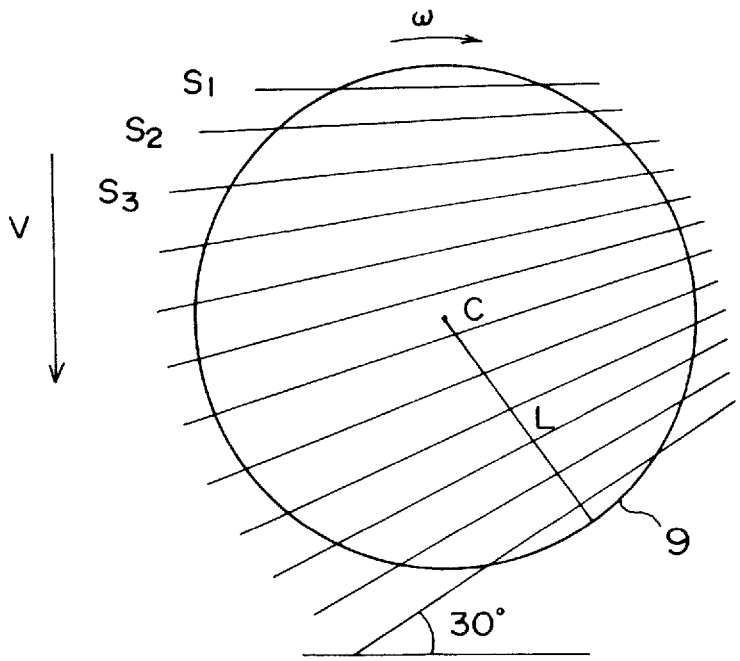
FIG. 2 is a schematic illustration showing movement of a contact line with a reciprocating motion of a drum and rotational motion of a workpiece when rotational angular velocity is small.
Figure 3:
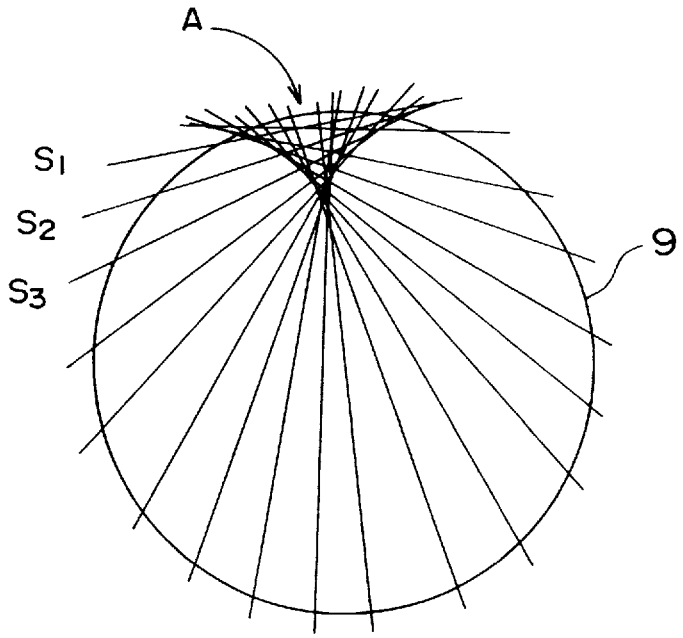
FIG. 3 is a schematic illustration showing the movement of the contact line with the reciprocating motion of the drum and the rotational motion of the workpiece when the rotational angular velocity of the workpiece is large.

FIGS. 2 and 3 show movement of contact lines S1, S2 . . . by one stroke with respect to time. Contact line means a line on which the reciprocating drum contacts the rotating wafer. In the drawings, movement of the contact lines S1, S2 . . . relative to the wafer is shown. A rotational center C of the wafer is the same as the rotational center of the stand 8. A reference character L represents a distance from the rotational center C of the wafer to a point of the wafer farthest from the center C. The wafer 9, in this embodiment, rotates in a direction shown by an arrow at angular velocity ω. The drum reciprocates at velocity V.

FIG. 2 shows a pattern when the rotational angular velocity ω of the wafer 9 is low, and FIG. 3 shows a pattern when the rotational angular velocity ω of the wafer 9 is high. When the rotational angular velocity is high, an overlapping portion shown by a reference character A in FIG. 3 is generated. This means that when the drum reciprocates on the wafer by one stroke, a overlapping portion shown by the reference character A is more polished than the other part of the wafer 9, and sufficient flatness of the wafer is not obtained. When the drum reciprocates a plurality of times a plurality of overlapping portions, shown by a reference character A, are formed, which forms a geometric pattern and deteriorates the flatness of the wafer. On the other hand, when the rotational speed is low, an overlapping of the contact lines does not occur and a sufficient flatness is obtained, as shown in FIG. 2.

An operating condition under which the overlapping of the contact lines does not occur on the wafer when the drum 3 reciprocates on the wafer 9 one time can be obtained theoretically as follows:

$$V/\omega > R$$

V: Velocity of the reciprocating drum

ω: Rotational angular velocity of the wafer

R: Radius of the wafer

In order to obtain appropriate flatness of the wafer under the above conditions, the velocity V of the drum or the number of the reciprocation strokes should be increased. This means that when the number of strokes of the reciprocating motion is increased to obtain a specific amount of polishing, the amount of polishing provided by each stroke can be reduced, and thus an absolute value of Polishing irregularity of each stroke can be reduced. Also, since a scanning pitch of the drum on the wafer can be made finer, sufficient flatness can be obtained.

Figure 4:
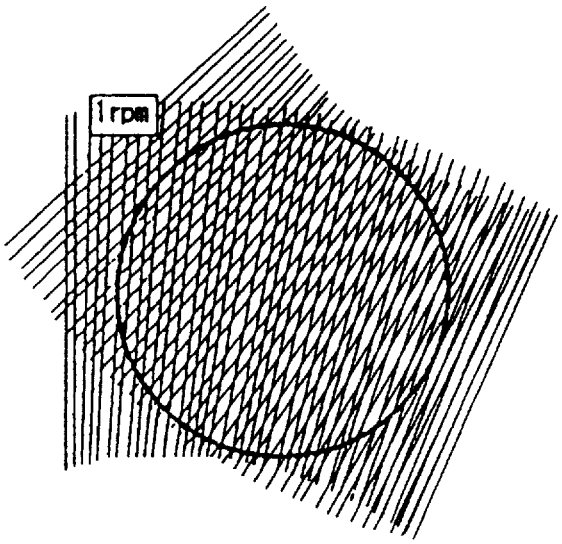
FIG. 4 is a schematic illustration showing the movement of the contact line with the reciprocating motion of the drum and the rotational motion of the workpiece when the rotational angular velocity of the workpiece is 1 rpm.
Figure 5:
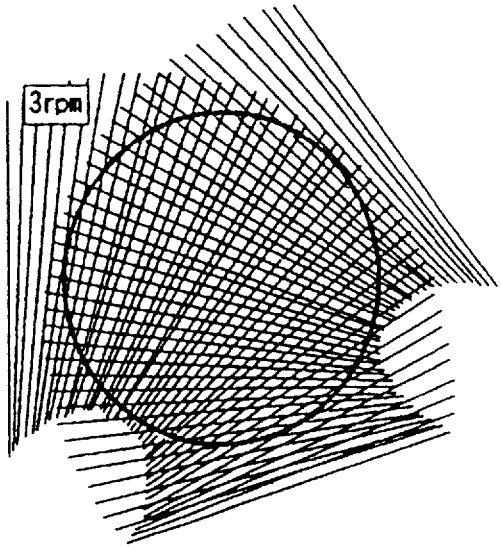
FIG. 5 is a schematic illustration showing the movement of the contact line with the reciprocating motion of the drum and the rotational motion of the workpiece when the rotational angular velocity of the workpiece is 3 rpm.
Figure 6:
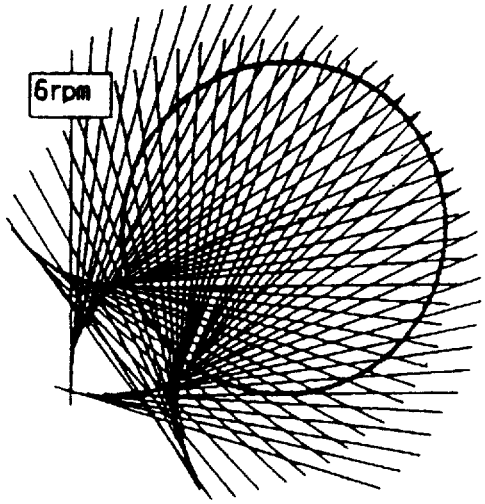
FIG. 6 is a schematic illustration showing the movement of the contact line with the reciprocating motion of the drum and the rotational motion of the workpiece when the rotational angular velocity of the workpiece is 6 rpm.
Figure 7:
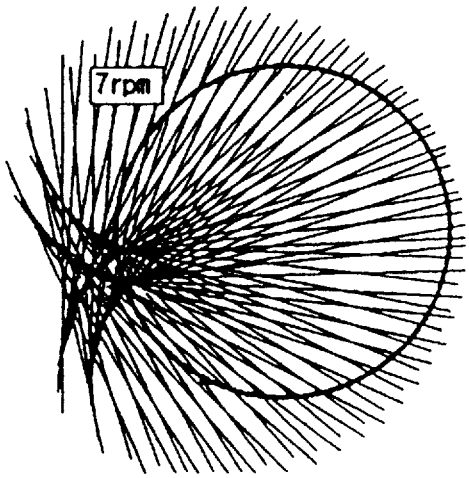
FIG. 7 is a schematic illustration showing the movement of the contact line with the reciprocating motion of the drum and the rotational motion of the workpiece when the rotational angular velocity of the workpiece is 7 rpm.
Figure 8:
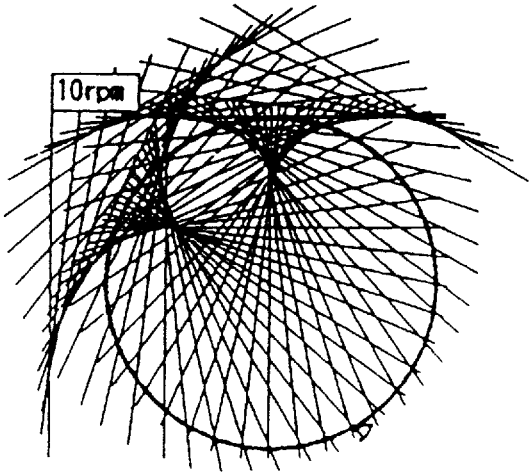
FIG. 8 is a schematic illustration showing the movement of the contact line with the reciprocating motion of the drum and the rotational motion of the workpiece when the rotational angular velocity of the workpiece is 10 rpm.
Figure 9:
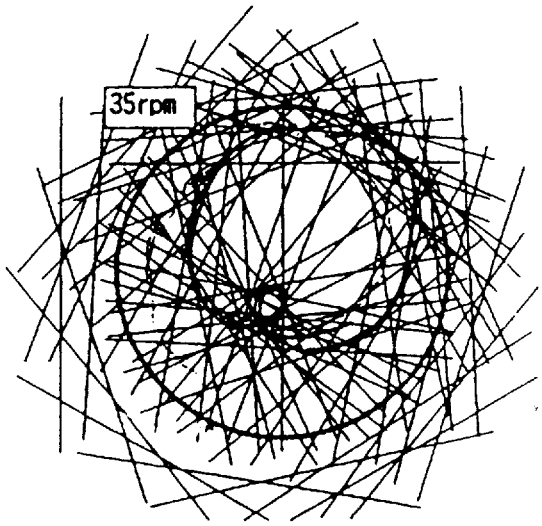
FIG. 9 is a schematic illustration showing the movement of the contact line with the reciprocating motion of the drum and the rotational motion of the workpiece when the rotational angular velocity of the workpiece is 35 rpm.

FIGS. 4 through 9 show movement of a contact line in one reciprocation of the drum when the reciprocating velocity V of the drum is 3000 mm/minute. FIG. 4 shows the result when the rotational angular velocity ω of the wafer is 1 rpm, FIG. 5 shows the result when the rotational angular velocity ω of the wafer is 3 rpm, FIG. 6 shows the result when the rotational angular velocity ω of the wafer is 6 rpm, FIG. 7 shows the result when the rotational angular velocity ω of the wafer is 7 rpm, FIG. 8 shows the result when the rotational angular velocity ω of the wafer is 10 rpm, and FIG. 9 shows the result when the rotational angular velocity ω of the wafer is 35 rpm. As shown in FIGS. 7, 8 and 9, when the velocity V of the reciprocating motion of the drum is 3000 mm/minute, an overlapping portion A is observed inside the wafer, in which the contact lines are concentrated on the wafer, and a polishing irregularity is formed at a rotational angular velocity over 7 rpm. When the rotational angular velocity is 1 rpm or 3 rpm, polishing irregularity is not produced, as shown in FIGS. 4 and 5. As is understood from the drawings, a rotational angular velocity ω of 6 rpm or 7 rpm is a critical value in attempting to prevent polishing irregularities.

Although in the above description the drum reciprocates on the stand on which the workpiece is rotatably mounted, the drum may be fixed and the stand may be reciprocated and rotated in the present invention.

Also, in the above description a semiconductor wafer is polished, however various electronic materials or optical materials may be Polished by the present invention.

According to the Polishing apparatus described above, the drum and stand are controlled so as to obtain the relation:

$$V/\omega > L$$

in which V represents velocity of reciprocation of the drum, ω represents rotational angular velocity of the workpiece and L represents distance from the rotational center to the radially outermost point of the workpiece. Because of such features, when the drum reciprocates on the workpiece and the workpiece is rotated, the problem of producing a polishing irregularity can be avoided. Therefore, the workpiece, such as a semiconductor wafer, can be suitably polished to a flat surface without irregularities.

Hereinafter, a second embodiment of the present invention will be described. The polishing pad shown in FIG. 1 is secured to the surface of the cylindrical drum 3 by adhesive. A back side of the polishing pad 16 such as a non-woven article or a polyurethane molded article is secured to the drum 3 by adhesive tape. In this embodiment, a seam 50 of the polishing pad 16 is arranged diagonally to the rotational axis of the drum 3, as shown in FIG. 1.

Figure 10:
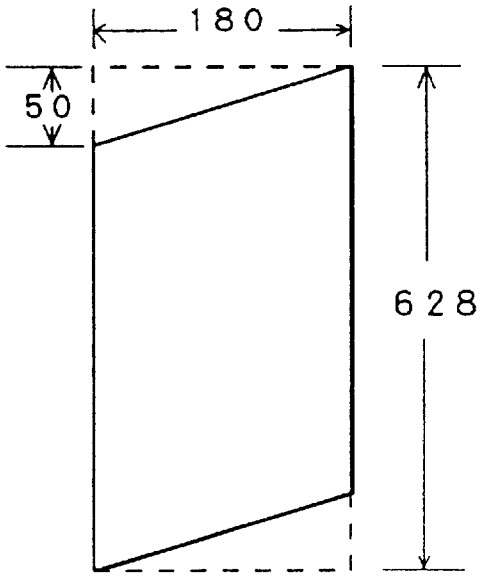
FIG. 10 is a development view showing the polishing pad shown in FIG. 1.

FIG. 10 is a development view showing the polishing pad. In one example of the Polishing pad used for a drum having a diameter of 200 mmΦ, the pad has a width of 180 mm, length of 628 mm and a cutout of 50 mm. In this example, the pad has a thickness of 1–2 mm. By the polishing pad provided on the cylindrical drum surface having the seam diagonal to the rotational axis of the drum, contact of the surface of the polishing pad with a workpiece is not interrupted during rotation of the entire circumferential surface of the drum. Thus, the workpiece to be polished is not substantially influenced by the seam of the polishing pad during rotation of the drum. Therefore, the present invention solves the problems of the conventional polishing apparatus such as impact, vibration, noise or deterioration of the flatness of the workpiece due to the seam being parallel to the rotational axis of the drum.

Figure 11:
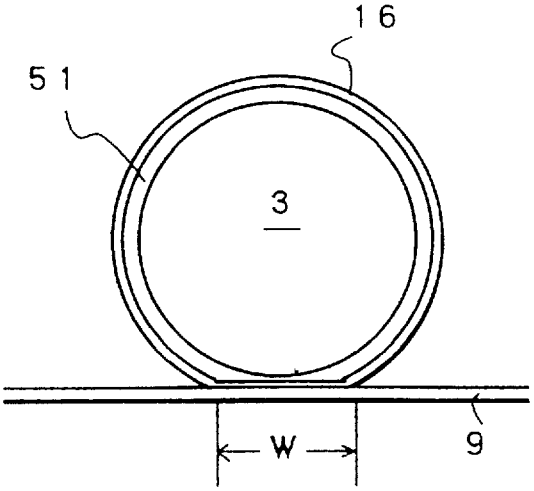
FIG. 11 is a cross-sectional view showing rotary drum of a second embodiment of the present invention.

FIG. 11 shows a drum of a third embodiment of the present invention. In the drum shown in FIG. 11, there is provided a non-water-absorbing elastic member 51, such as a rubber member, on the circumferential surface of the drum 3. Polishing pad 16 is secured on the elastic member 51. The thickness of the elastic member, when the drum has a diameter of 200 mmΦ is preferably 1 to several mm. Alternatively, the elastic member 51, such as rubber, may be secured to the drum by adhesive or a cylindrical rubber material may be fitted over the outside surface of the drum 3. The polishing pad has a seam diagonal to the rotating axis of the drum in the same manner as that of the second embodiment. The polishing pad can be secured to the elastic member 51 through adhesive. The general structure of the polishing apparatus of this embodiment is the same as that of the first embodiment.

When a single-layer polishing pad of hard material is provided on a drum of, for example, stainless steel in a conventional polishing apparatus, the drum deflects due to a small error in roundness of the drum or eccentricity of the rotational axis. Since the surface of the polishing pad lacks elasticity, this causes a vibration and deteriorates the flatness of the polished surface of the semiconductor wafer. Also, since an area of contact between the polishing pad and the workpiece is linear, the polishing speed cannot be increased. In this embodiment, due to the elastic member 51 provided between the drum 3 and the polishing pad 16, the drum contacts the workpiece over a surface area of width W, not a linear line. Since polishing is conducted over a contact area having width W, rate or speed of polishing is improved even when the speed of rotation is not changed. Also, since the elastic member operates as a vibration absorbing member, suitable polishing can be conducted without vibration and noise, and thus the flatness of the polished surface of the workpiece is improved.

In the conventional polishing apparatus, there is occasionally provided a water-absorbing insert such as a non-woven fabric between the polishing pad and the drum. When contraction and expansion of such insert are repeated, the water-absorbing insert becomes peeled away because of absorbing abrasive liquid therein. However, when a non-water absorbing material, such as rubber, is used as an elastic member, such conventional problem can be solved in that the elastic member does not absorb abrasive liquid and the polishing pad does not peel away.

Figure 12:
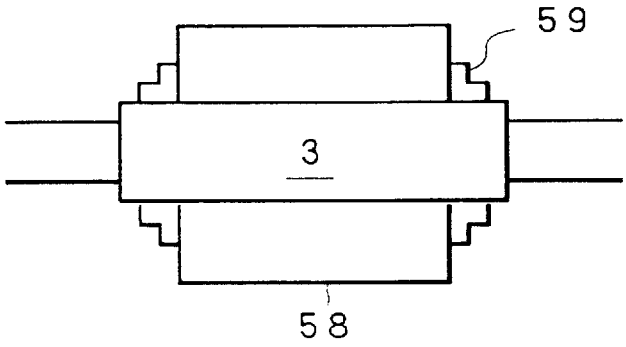
FIG. 12 is a schematic illustration showing a rotary drum of a third embodiment of the present invention.

FIG. 12 shows a rotary drum of a fourth embodiment of the present invention. In this embodiment, the general structure of the polishing apparatus is the same as that of the first embodiment.

In this embodiment, a rotary drum of, for example, stainless steel is provided with a thick polishing pad 58. The polishing pad 58 is, for example, a thick polyurethane cylindrical member having an inner diameter of 50Φ mm and an outer diameter of 200Φ mm. The drum is inserted within the inner diameter of the polishing pad and the polishing pad is secured to the rotational axis or axle by a pad holder 59. The drum may be inserted in the polishing pad prepared in advance and be secured by holder 59. Also, the polishing pad of polyurethane may be directly molded to the metal drum. Also, the polishing pad may be inserted or molded directly to the axis or axle without the drum. By use of the thick polishing pad 58, since the pad has no seam, the problems of the conventional polishing apparatus such as impact, vibration, noise or deterioration of flatness due to the seam can be solved. Since the polishing pad is subjected to frequent dressing to condition the surface thereof, the pad is worn out after a certain period of usage and requires periodic replacement. When the pad is thin, the period for replacement is shortened, which deteriorates the efficiency of production of the workpieces. However, by use of the thick polishing pad 58, the period for replacement is extended and maintenance of the polishing apparatus is improved.

In the above embodiments, a material such as non-woven fabric or polyurethane is used as the polishing pad. However, other materials can be used in the present invention as long as they are suitable for fine polishing. Also, in the above description, rubber is used as the non-water absorbing elastic member. However, other materials can be used as long as they are non-water absorbing materials of appropriate elasticity. Further, although the above description involved polishing of semiconductor wafers, the invention can be used for polishing various electronic materials or optical materials.

Moreover, needless to say, a non-water absorbing elastic member can be provided between the thin seamless polishing pad and the drum.

Although certain preferred embodiments of the present invention have been shown and described in detail, it should be 15 understood that various changes and modifications may be made thereto without departing from the scope of the appended claims.

What is claimed is:

1. A polishing apparatus comprising:

a rotatable drum provided on a surface thereof with a polishing pad;

a stand to support a workpiece to be polished;

pressing means for pressing said drum to a surface of the workpiece;

reciprocating means for reciprocating one of said stand or said drum so that said drum contacts an entire surface of the workpiece;

rotating means for rotating said stand;

supplying means for delivering an abrasive liquid including abrasive grains to said polishing pad; and controlling means for controlling said reciprocating means and said rotating means so as to obtain a relationship:

$$V/\omega > L$$

in which V represents velocity of relative reciprocation between said drum and the workpiece supported on said stand to polish the entire surface of the workpiece, ω represents rotational angular velocity of the workpiece supported on said stand, and L represents a distance from a rotational center of the workpiece supported on said stand to a point on the workpiece furthest from said rotational center.

2. A polishing apparatus according to claim 1, wherein a seam of said polishing pad is arranged to extend diagonally with respect to a rotating axis of said drum.

3. A polishing apparatus according to claim 1, further comprising a non-water absorbing elastic pad provided between said surface of said drum and said polishing pad.

4. A method of polishing a workpiece by use of a polishing apparatus including a rotatable drum provided on a surface thereof with a polishing pad, a stand supporting a workpiece to be polished, pressing means for pressing said drum to a surface of the workpiece, and reciprocating means for reciprocating one of said stand or said drum so that said drum contacts an entire surface of the workpiece, rotating means for rotating said stand, and supplying means for delivering an abrasive liquid including abrasive grains to said polishing pad, said method comprising:

controlling said reciprocating means and said rotating means so as to obtain a relationship:

$$V/\omega > L$$

in which V represents velocity of relative reciprocation between said drum and said workpiece to polish the entire surface of said workpiece, ω represents rotational angular velocity of said workpiece supported on said stand, and L represents a distance from a rotational center of said workpiece to a point on said workpiece furthest from said rotational center.

5. A polishing apparatus comprising:

a rotatable drum provided on a surface thereof with a polishing pad;

a stand to support a workpiece to be polished;

pressing means for pressing said drum to a surface of the workpiece;

reciprocating means for reciprocating one of said stand or said drum so that said drum contacts an entire surface of the workpiece;

rotating means for rotating said stand;

supplying means for delivering an abrasive liquid including abrasive grains to said polishing pad; and said polishing pad being a seamless cylindrical pad formed to be of a thick cylinder shape and mounted on said surface of said drum.

6. A polishing apparatus comprising:

a rotatable drum provided on a surface thereof with a polishing pad;

a stand to support a workpiece to be polished;

pressing means for pressing said drum to a surface of the workpiece;

reciprocating means for reciprocating one of said stand or said drum so that said drum contacts an entire surface of the workpiece;

rotating means for rotating said stand;

supplying means for delivering an abrasive liquid including abrasive grains to said polishing pad; and said polishing pad being a seamless cylindrical pad that is molded directly to said drum.

* * * * *